US011232760B2

(12) United States Patent
Huang

(10) Patent No.: US 11,232,760 B2
(45) Date of Patent: Jan. 25, 2022

(54) LIQUID CRYSTAL DISPLAY PANEL ALLEVIATING COLOR SHIFT PROBLEM DUE TO LARGE VIEWING ANGLE

(71) Applicant: HKC CORPORATION LIMITED, Shenzhen (CN)

(72) Inventor: Beizhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 8 days.

(21) Appl. No.: 16/314,390

(22) PCT Filed: Dec. 13, 2017

(86) PCT No.: PCT/CN2017/115783
§ 371 (c)(1),
(2) Date: Dec. 29, 2018

(87) PCT Pub. No.: WO2019/052042
PCT Pub. Date: Mar. 21, 2019

(65) Prior Publication Data

US 2021/0225302 A1 Jul. 22, 2021

(30) Foreign Application Priority Data

Sep. 18, 2017 (CN) ..... 201710839663.6

(51) Int. Cl.
*G09G 3/36* (2006.01)

(52) U.S. Cl.
CPC ... *G09G 3/3607* (2013.01); *G09G 2300/0452* (2013.01); *G09G 2320/0242* (2013.01); *G09G 2320/0276* (2013.01)

(58) Field of Classification Search
CPC ..... G09G 3/36; G09G 3/3607; G09G 3/3611; G09G 3/3622; G09G 3/3625; G09G 3/364; G09G 3/3644; G09G 3/3648; G09G 3/3666; G09G 3/3677; G09G 3/3681; G09G 2300/0452; G09G 2320/0242; G09G 2320/028
USPC ..... 345/87–104
See application file for complete search history.

(56) References Cited

U.S. PATENT DOCUMENTS

2012/0281033 A1* 11/2012 Yoshida ..... G09G 3/3648 345/694
2017/0018238 A1* 1/2017 Kang ..... G09G 3/3607
2017/0154587 A1* 6/2017 Chen ..... G09G 3/3607
2018/0174535 A1* 6/2018 Chen ..... G09G 3/007
(Continued)

FOREIGN PATENT DOCUMENTS

CN 102254535 A 11/2011
CN 106531106 A 3/2017
(Continued)

*Primary Examiner* — Alexander Eisen
*Assistant Examiner* — Nelson Lam
(74) *Attorney, Agent, or Firm* — Kilpatrick Townsend & Stockton, LLP

(57) ABSTRACT

A driving method for a display device and a display device are disclosed. The driving method includes: obtaining a pre-display image; obtaining, according to an average of corresponding preset grayscale values of two blue sub-pixels in a pixel group, n sets of target grayscale value pairs of the pixel group by table lookup; and displaying a same pre-display image in m continuous frames of display cycles.

20 Claims, 5 Drawing Sheets

(56) References Cited

U.S. PATENT DOCUMENTS

| | | | | |
|---|---|---|---|---|
| 2018/0374435 | A1* | 12/2018 | Chen | G09G 3/3611 |
| 2018/0374436 | A1* | 12/2018 | Chen | G09G 3/3607 |
| 2019/0005896 | A1* | 1/2019 | Chen | G09G 3/3406 |
| 2019/0043433 | A1* | 2/2019 | Chen | G09G 3/36 |
| 2020/0035172 | A1* | 1/2020 | Chen | G09G 3/3666 |
| 2020/0184911 | A1* | 6/2020 | Chen | G09G 3/3625 |
| 2020/0294459 | A1* | 9/2020 | Huang | G09G 3/2022 |
| 2021/0280120 | A1* | 9/2021 | Zhang | G09G 3/2003 |

FOREIGN PATENT DOCUMENTS

| | | | |
|---|---|---|---|
| CN | 106782371 | A | 5/2017 |
| CN | 106842724 | A | 6/2017 |
| TW | 200928491 | A | 7/2009 |
| WO | 2016171096 | A1 | 10/2016 |

* cited by examiner

LIQUID CRYSTAL DISPLAY PANEL ALLEVIATING COLOR SHIFT PROBLEM DUE TO LARGE VIEWING ANGLE

CROSS-REFERENCE TO RELATED APPLICATIONS

This application is a U.S. national Stage of International Application No. PCT/CN2017/115783, filed on Dec. 13, 2017, designating the United States, which claims priority to Chinese Patent Application No. 201710839663.6, filed with the Chinese Patent Office on Sep. 18, 2017 and entitled "DRIVING METHOD FOR DISPLAY DEVICE AND DISPLAY DEVICE", the content of each of which is hereby incorporated by reference in its entirety.

FIELD

This disclosure relates to the field of display technologies, and more particularly relates to a driving method for a display device and a display device.

BACKGROUND

Conventional large-size liquid crystal displays use negative vertical alignment (VA) liquid crystal or in-plane switching (IPS) liquid crystal technology. In the case of a large viewing angle, brightness of a pixel of the VA liquid crystal display is rapidly saturated along with the driving voltage, which causes severe color shift of the liquid crystal display under a large viewing angle, thereby affecting image display quality of the liquid crystal display.

When original driving signals for driving a sub-pixel in a liquid crystal display panel include a high voltage signal and a low voltage signal to drive the sub-pixel in the liquid crystal display panel, the problem of color shift of the liquid crystal display in the case of a large viewing angle can be improved. One solution to the problem of color shift of a liquid crystal display under a large viewing angle is to divide each sub-pixel in the liquid crystal display panel into primary and secondary pixels; by providing different driving voltages to the primary and secondary pixels in each sub-pixel, liquid crystal molecules corresponding to the primary and secondary pixels in each sub-pixel have different deflection directions, thereby enhancing optical isotropy of the liquid crystal molecules, and thus solving the problem of color shift of the liquid crystal display panel under a large viewing angle. However, providing different driving voltages for the primary and secondary pixels in each sub-pixel requires that some metal wires and thin film transistor elements respectively drive the primary and secondary pixels for display, but these metal wires and the thin film transistor elements may affect illumination of the liquid crystal display panel, so that a light transmission opening area of the liquid crystal display panel is greatly reduced, affecting transmittance of the liquid crystal display panel, and causing increase of backlight costs of the liquid crystal display panel.

SUMMARY

In view of this, embodiments of this disclosure provide a driving method for a display device and a display device. By displaying a same pre-display image in m continuous frames of display cycles, and setting that in a same frame of display cycle, grayscale values of two blue sub-pixels in a pixel group are a first target grayscale value and a second target grayscale value in a set of target grayscale value pair, the first target grayscale value of each set of target grayscale value pair is greater than a preset grayscale value of a corresponding blue sub-pixel, and the second target grayscale value is smaller than a preset grayscale value of a corresponding blue sub-pixel, the problem of color shift of a liquid crystal display panel under a large viewing angle is alleviated, and the problem that the metal wires and thin film transistor elements affect transmittance of the display panel in the prior art is resolved. It is also set that in at least two frames of display cycles, target grayscale value pairs corresponding to pixel groups in a same position on the display panel are different, while the target grayscale values corresponding to the pixel groups in the same position on the display panel in each frame of display cycle are the same, so that the gamma curve corresponding to a blue sub-pixel can approximate to the front-viewing-angle gamma curve to the greatest extent whether it corresponds to a high grayscale region or a low grayscale region, thereby further alleviating the problem of color shift of the liquid crystal display panel under the large viewing angle.

An embodiment of this disclosure provides a driving method for a display device, including:

obtaining a pre-display image, where each sub-pixel in the pre-display image corresponds to a preset grayscale value;

obtaining, according to an average of preset grayscale values corresponding to two blue sub-pixels in each pixel group, n sets of target grayscale value pairs corresponding to the pixel group by table lookup, a display panel including a plurality of pixel groups, and the pixel group including the two blue sub-pixels, where each set of the target grayscale value pair includes a first target grayscale value and a second target grayscale value, grayscale value differences of the n set of target grayscale value pairs are different, and the grayscale value difference is equal to the first target grayscale value minus the second target grayscale value of a same set of target grayscale value pair; and displaying a same pre-display image in m continuous frames of display cycles, where in a same frame of display cycle, grayscale values of the two blue sub-pixels in the pixel group are the first target grayscale value and the second target grayscale value in a set of target grayscale value pair, the first target grayscale value of each set of target grayscale value pair is greater than a preset grayscale value of a corresponding blue sub-pixel, the second target grayscale value is smaller than a preset grayscale value of a corresponding blue sub-pixel, and in at least two frames of display cycles, target grayscale value pairs corresponding to pixel groups in a same position on the display panel are different, and m is an integer greater than 1, and n is an integer greater than 1 and less than or equal to m.

An embodiment of this disclosure provides a display device, including:

an image obtaining module, configured to obtain a pre-display image, where each sub-pixel in the pre-display image corresponds to a preset grayscale value;

a lookup module, electrically connected to the image obtaining module, and configured to obtain, according to an average of preset grayscale values corresponding to the two blue sub-pixels in the pixel group, n sets of target grayscale value pairs corresponding to the pixel group by table lookup;

a first control module, electrically connected to the lookup module, where each set of the target grayscale value pair includes a first target grayscale value and a second target grayscale value, the first control module is configured to control grayscale value differences of the n sets of target grayscale value pairs to be different, and the grayscale value difference is equal to the first target grayscale value minus the second target grayscale value of a same set of target grayscale value pair;

a drive module, electrically connected to the first control module and the display panel, and configured to drive a display panel to display a same pre-display image in m continuous frames of display cycles;

a second control module, electrically connected to the lookup module and the drive module, where in a same frame of display cycle, the grayscale values of the two blue sub-pixels in the pixel group are the first target grayscale value and the second target grayscale value in a set of target grayscale value pair, the second control module is configured to control the first target grayscale value of each set of target grayscale value pair to be greater than a preset grayscale value of a corresponding blue sub-pixel and the second target grayscale value to be smaller than a preset grayscale value of a corresponding blue sub-pixel, and in at least two frames of display cycles, and target grayscale value pairs corresponding to pixel groups in a same position on the display panel are different, where m is an integer greater than 1, and n is an integer greater than 1 and less than or equal to m; and a display panel, including a plurality of pixel groups, and each of the pixel groups including the two blue sub-pixels.

An embodiment of this disclosure further provides a driving method for a display device, including:

obtaining a pre-display image, where each sub-pixel in the pre-display image corresponds to a preset grayscale value;

obtaining, according to an average of preset grayscale values corresponding to two blue sub-pixels in each pixel group, n sets of target grayscale value pairs corresponding to the pixel group by table lookup, a display panel including a plurality of pixel groups, and the pixel group including the two blue sub-pixels, where each set of the target grayscale value pairs includes a first target grayscale value and a second target grayscale value, grayscale value differences of the n sets of target grayscale value pairs are different, and the grayscale value difference is equal to the first target grayscale value minus the second target grayscale value of a same set of target grayscale value pair;

displaying a same pre-display image in m continuous frames of display cycles;

where in a same frame of display cycle, grayscale values of the two blue sub-pixels in the pixel group are the first target grayscale value and the second target grayscale value in a set of target grayscale value pair; the first target grayscale value of each set of target grayscale value pair is greater than a preset grayscale value of a corresponding blue sub-pixel, the second target grayscale value is smaller than a preset grayscale value of a corresponding blue sub-pixel, and in at least two frames of display cycles, target grayscale value pairs corresponding to pixel groups in a same position on the display panel are different; and in one of two neighboring frames of display cycles, a grayscale value of a blue sub-pixel on the display panel is greater than a preset grayscale value corresponding to the blue sub-pixel, in one of the two neighboring frames of display cycles, a grayscale value of a blue sub-pixel in a same position on the display panel is smaller than a preset grayscale value corresponding to the blue sub-pixel, and in the m frames of display cycles, an average of a first target grayscale value and a second target grayscale value of blue sub-pixels in a same position on the display panel is equal to preset grayscale values corresponding to the blue sub-pixels, where m is an even number greater than 2, and n is an integer greater than 1 and less than or equal to m.

BRIEF DESCRIPTION OF THE DRAWINGS

To describe the technical solutions in the embodiments of this disclosure more clearly, the following briefly introduces the embodiments or the required accompanying drawings. Apparently, the accompanying drawings in the following description show some embodiments of this disclosure, and a person of ordinary skill in the art may still derive other drawings from these accompanying drawings without creative efforts.

DETAILED DESCRIPTION OF THE INVENTION

To make the objectives, technical solutions, and advantages of this disclosure clearer, the following clearly and completely describes the technical solutions in this disclosure with reference to the accompanying drawings in the embodiments of this disclosure. Apparently, the described embodiments are a part rather than all of the embodiments of this disclosure. All other embodiments obtained by a person of ordinary skill in the art based on the embodiments of this disclosure without creative efforts shall fall within the protection scope of this disclosure.

Figure 1:
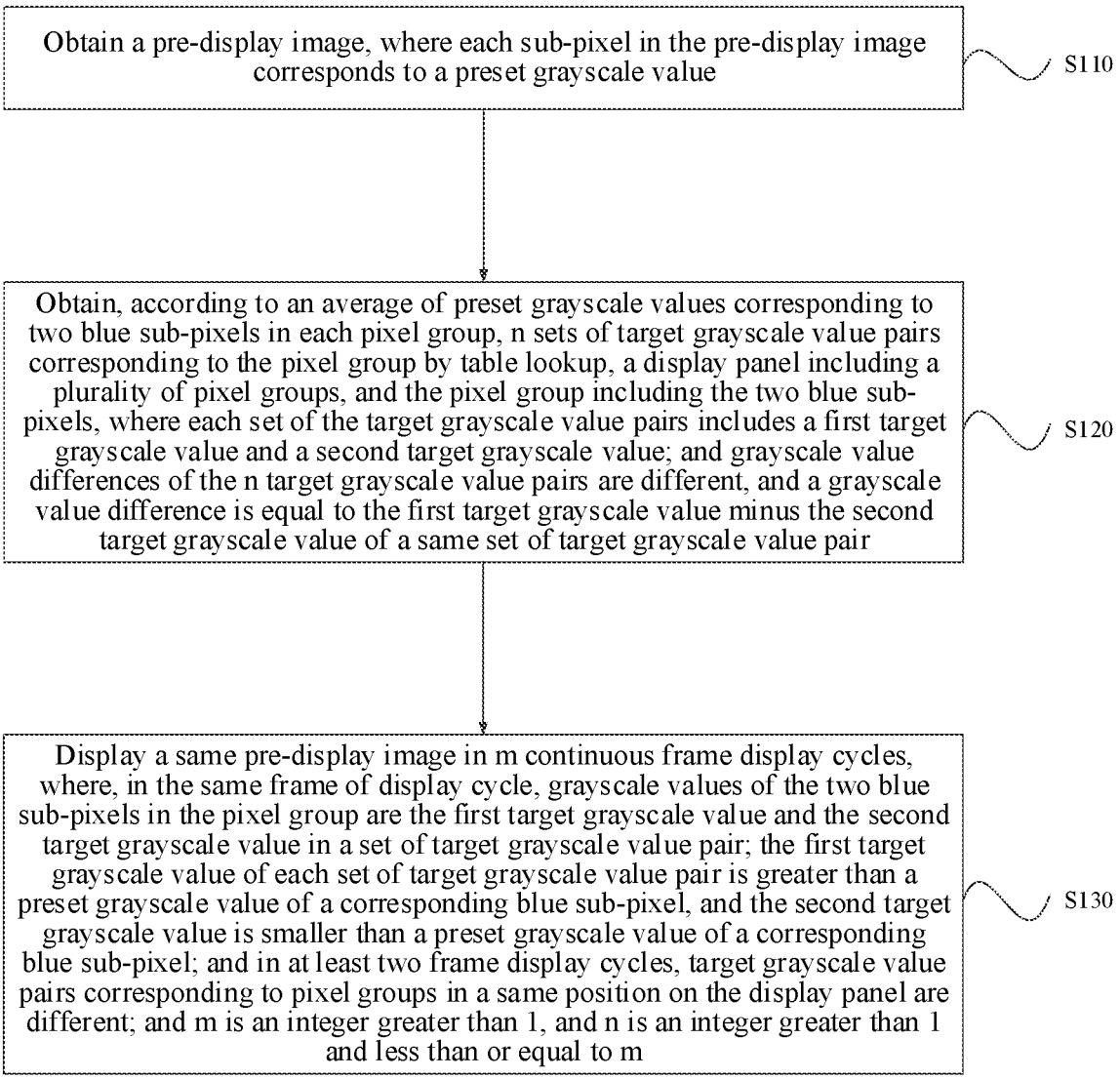
FIG. 1 is a flowchart of a driving method for a display device according to an embodiment of this disclosure.

FIG. 1 is a flowchart of a driving method for a display device according to an embodiment of this disclosure. The driving method can be applied to a scene that needs to drive a display device for display, and can be executed by a display device provided by the embodiments of this disclosure. The method includes steps S110 to S130.

Step S110: Obtain a pre-display image, where each sub-pixel in the pre-display image corresponds to a preset grayscale value.

Optionally, the pre-display image includes a plurality of sub-pixels. For the pre-display image, each sub-pixel corresponds to a preset grayscale value according to a position of the sub-pixel in the pre-display image so as to form the pre-display image.

Step S120: Obtain, according to an average of preset grayscale values corresponding to two blue sub-pixels in each pixel group, n sets of target grayscale value pairs corresponding to the pixel group by table lookup, a display panel of a display device including a plurality of pixel groups, and the pixel group including the two blue sub-pixels, where each set of the target grayscale value pairs includes a first target grayscale value and a second target grayscale value; and grayscale value differences of the n sets of target grayscale value pairs are different, and the grayscale value difference is equal to the first target grayscale value minus the second target grayscale value of a same set of target grayscale value pair.

Exemplarily, pixels on the display panel are divided into a plurality of pixel groups, and each pixel group includes two pixels. For each pixel group, in accordance with the fact that the two blue sub-pixels of two pixels included in the pixel group respectively correspond to a preset grayscale value, n sets of target grayscale value pairs corresponding to the pixel group can be obtained by table lookup according to an average of two preset grayscale values, where each set of the target grayscale value pairs includes a first target grayscale value and a second target grayscale value. A wavelength of light emitted by a blue sub-pixel B is greater than or equal to 400 nm and less than or equal to 480 nm.

Exemplarily, n may be set to 2. Table 1 shows a correspondence between an average of preset grayscale values of blue sub-pixels and two sets of target grayscale value pairs according to the embodiment of this disclosure. Exemplarily, a preset grayscale value of one blue sub-pixel in a pixel group may be set to 1.5 and a preset gray scale value of the other blue sub-pixel may be set to 2.5, then an average of preset grayscale values corresponding to the two blue sub-pixels in the pixel group is 2. Referring to Table 1, the two sets of target grayscale value pairs corresponding to the pixel group 10 may be respectively set to 80 and 5, and 70 and 10.

TABLE 1

Table of correspondence between average of preset grayscale values of blue sub-pixels and two sets of target grayscale value pairs

| Average of Preset Grayscale | First Set of Target Grayscale Value Pair | | Second Set of Target Grayscale Value Pair | |
|---|---|---|---|---|
| Values | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . . . | . . . | . . . | . . . | . . . |
| 255 | 255 | 128 | 255 | 160 |

Step S130: Display a same pre-display image in m continuous frames of display cycles, where in a same frame of display cycle, grayscale values of the two blue sub-pixels in the pixel group are the first target grayscale value and the second target grayscale value in a set of target grayscale value pair; the first target grayscale value of each set of target grayscale value pair is greater than a preset grayscale value of a corresponding blue sub-pixel, and the second target grayscale value is smaller than a preset grayscale value of a corresponding blue sub-pixel; in at least two frames of display cycles, target grayscale value pairs corresponding to pixel groups in a same position on the display panel are different; and m is an integer greater than 1, and n is an integer greater than 1 and less than or equal to m.

Figure 2:
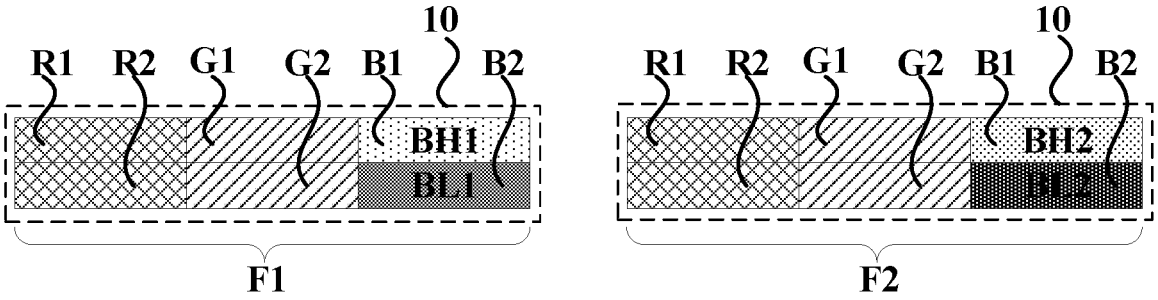
FIG. 2 is a structural schematic diagram of pixel groups in a same position of a display panel in two frames of display cycles according to an embodiment of this disclosure.

Exemplarily, m may be set to 2. That is, a same pre-display image can be displayed in two continuous frames of display cycles. FIG. 2 is a structural schematic diagram of pixel groups on a display panel in two frames of display cycles according to an embodiment of this disclosure. As shown in FIG. 2, each pixel on the display panel may include three sub-pixels, the three sub-pixels in each pixel may be, for example, a red sub-pixel R, a blue sub-pixel B and a green sub-pixel G. In a same frame of display cycle, grayscale values of two blue sub-pixels B1 and B2 in a pixel group 10 on the display panel are the first target grayscale value and the second target grayscale value in a set of target grayscale value pair, the first target grayscale value of each set of target grayscale value pair is greater than a preset grayscale value of a corresponding blue sub-pixel, the second target grayscale value is smaller than a preset grayscale value of a corresponding blue sub-pixel, and grayscale value differences of the two sets of target grayscale value pairs are different, that is, a difference of the first target grayscale value minus the second target grayscale value in the target grayscale value pair corresponding to the pixel group 10 in a first frame of display cycle F1 is different from a difference of the first target grayscale value minus the second target grayscale value in the target grayscale value pair corresponding to the pixel group 10 in a second frame of display cycle F2.

In two frames of display cycles F1 and F2, the target grayscale value pairs corresponding to pixel groups 10 in a same position on the display panel are set to be different. Exemplarily, it may be set that in two frames of display cycles, the target grayscale value pairs corresponding to the pixel groups 10 in the same position on the display panel are a first set of target grayscale value pair and a second set of target grayscale value pair, the first set of target grayscale value pair includes a first target grayscale value BH1 and a second target grayscale value BL1, and the second set of target grayscale value pair includes a first target grayscale value BH2 and a second target grayscale value BL2. Exemplarily, referring to FIG. 2 and Table 1, an average of preset grayscale values of the two blue sub-pixels B1 and B2 in the pixel group 10 may be set to 2, and then according to Table 1, it can be obtained that the first target grayscale value BH1 in the first set of target grayscale value pair is 80 and the second target grayscale value BL1 is 5; and the first target grayscale value BH2 in the second set of target grayscale value pair is 70 and the second target grayscale value BL2 is 10. As shown in FIG. 2, it may be set that in the first frame of display cycle F1, a grayscale value of the blue sub-pixel B1 is the first target grayscale value 80 in the first set of target grayscale value pair, a grayscale value of the blue sub-pixel B2 is the second target grayscale value 5 in the first set of target grayscale value pair, and in the second frame of display cycle F2, the grayscale value of the blue sub-pixel B1 in the same pixel group 10 is the first target grayscale value 70 in the second set of target grayscale value pair, and the grayscale value of the blue sub-pixel B2 is the second target grayscale value 10 in the second set of target grayscale value pair.

Exemplarily, it may be set that the preset grayscale values of the blue sub-pixel B1 and the blue sub-pixel B2 in the pixel group 10 are both 50, then the first target grayscale value 80 in the first target grayscale value pair is greater than the preset grayscale value 50 of the blue sub-pixel B1, and the second target grayscale value 5 is smaller than the preset grayscale value 50 of the blue sub-pixel B2, that is, the polarity of a difference between the first target grayscale value BH1 in the first set of target grayscale value pair and the preset grayscale value of the corresponding blue sub-pixel B1 is different from the polarity of a difference between the second target grayscale value BL1 in the first target grayscale value pair and the preset grayscale value of the corresponding blue sub-pixel B2. Similarly, the first target grayscale value 70 in the second target grayscale value pair is greater than the preset grayscale value 50 of the blue sub-pixel B1, and the second target grayscale value 10 in the second target grayscale value pair is smaller than the preset grayscale value 50 of the blue sub-pixel B2, that is, the polarity of a difference between the first target grayscale value BH2 in the second set of target grayscale value pair and the preset grayscale value of the corresponding blue sub-pixel B1 is different from the polarity of a difference between the second target grayscale value BL2 in the second target grayscale value pair and the preset grayscale value of the corresponding blue sub-pixel B2. A difference between the first target grayscale value BH1 and the second target grayscale value BL1 in the first set of target grayscale value pair is 75, and a difference between the first target grayscale value BH2 and the second target grayscale value BL2 in the second target grayscale value pair is 70. That is, differences between the first target grayscale value and the second target grayscale value in the two sets of target grayscale value pairs are different. That is, grayscale value differences of the two sets of target grayscale value pairs are different.

Figure 3A:
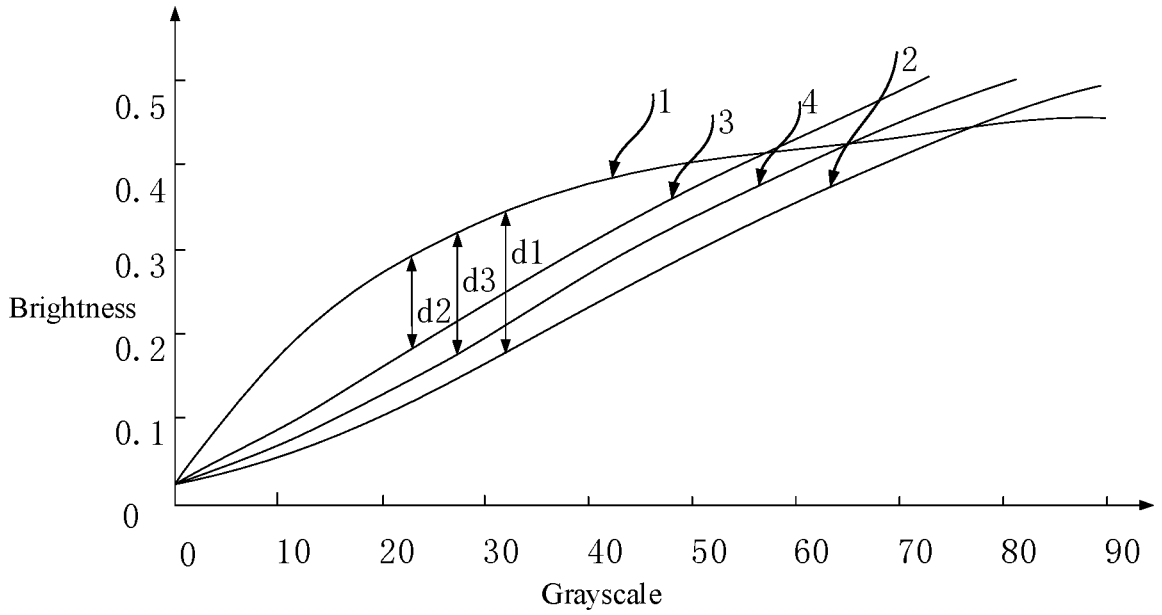
FIG. 3*a* is a schematic diagram of a gamma curve low grayscale region of blue sub-pixels in pixel groups corresponding to different gray scale value pairs according to an embodiment of this disclosure.
Figure 3B:
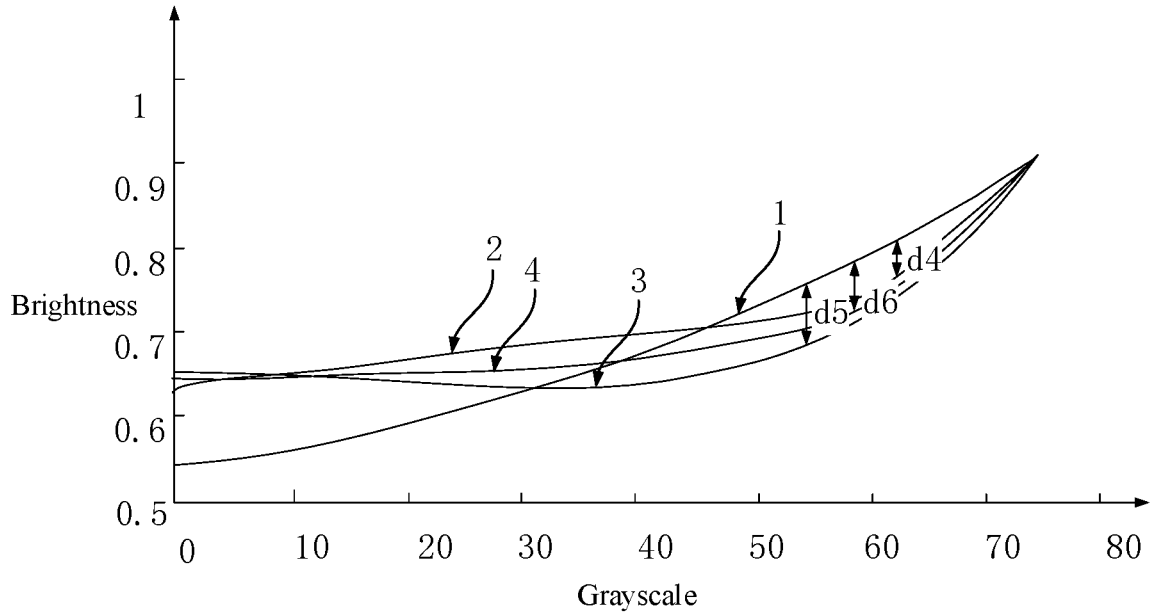
FIG. 3*b* is a schematic diagram of a gamma curve high grayscale region of blue sub-pixels in pixel groups corresponding to different gray scale value pairs according to an embodiment of this disclosure.

FIG. 3*a* is a schematic diagram of a gamma curve low grayscale region of blue sub-pixels in pixel groups corresponding to different gray scale value pairs according to an embodiment of this disclosure; and FIG. 3*b* is a schematic diagram of a gamma curve high grayscale region of blue sub-pixels in pixel groups corresponding to different gray scale value pairs according to an embodiment of this disclosure. Referring to FIG. 2, FIG. 3*a* and FIG. 3*b*, curve 1 is a target gamma curve, that is, a front viewing angle gamma curve. Higher coincidence of an actual gamma curve of the blue sub-pixel in the pixel group with the curve 1 indicates the less obvious color shift problem of the liquid crystal display panel under a large viewing angle. Curve 2 is a corresponding gamma curve when the grayscale values of the two blue sub-pixels B1 and B2 in the pixel group 10 are always a first target grayscale value and a second target grayscale value in a set target grayscale value pair. Curve 3 is a corresponding gamma curve when the grayscale values of the two blue sub-pixels B1 and B2 in the pixel group 10 are always a first target grayscale value and a second target grayscale value in another target grayscale value pair. Curve 4 is a corresponding gamma curve when the target grayscale value pairs of the pixel groups 10 in the same position on the display panel in at least two frames of display cycles are set to be different.

As can be seen from FIG. 3*a*, a difference between actual brightness of the low grayscale region curve 2 and target brightness of the curve 1 is d1, a difference between actual brightness of the curve 3 and the target brightness of the curve 1 is d2, a difference between actual brightness of the curve 4 and the target brightness of the curve 1 is d3, and d1>d3>d2. As can be seen from FIG. 3*b*, the difference between the actual brightness of the high grayscale region curve 2 and the target brightness of the curve 1 is d4, the difference between the actual brightness of the curve 3 and the target brightness of the curve 1 is d5, the difference between the actual brightness of the curve 4 and the target brightness of the curve 1 is d6, and d4<d6<d5. That is, in case of the corresponding gamma curve when the grayscale values of the two blue sub-pixels B1 and B2 in the pixel group 10 are always a first target grayscale value and a second target grayscale value in a set of target grayscale value pair, it is impossible to approach the target curve 1 at the same time in the low grayscale region and the high grayscale region. However, the curve 4 can approach the target curve 1 at the same time in the low grayscale region and the high grayscale region with respect to the curve 2 and the curve 3. In the embodiment of this disclosure, by displaying the same pre-display image in m continuous frames of display cycles, and setting that the target grayscale value pairs corresponding to the pixel groups 10 in the same position on the display panel are different in at least two frames of display cycles, while the grayscale values of the two blue sub-pixels B1 and B2 in the pixel group 10 are always the first target grayscale value and the second target grayscale value in a set of target grayscale value pair, the actual gamma curve of the blue sub-pixels in the pixel group can approach the target curve at the same time in the low grayscale region and the high grayscale region, thereby further alleviating the problem of color shift of the liquid crystal display panel under a large viewing angle.

It should be noted that Table 1 only exemplarily shows one correspondence between the average of the preset grayscale values of the two blue sub-pixels B1 and B2 in the pixel group 10 and the two sets of target grayscale value pairs, and the average of the preset grayscale values of the two blue sub-pixels B1 and B2 in the pixel group 10 and the target grayscale value pair may also be in another correspondence, which is not limited in the embodiment of this disclosure as long as the first target grayscale value of each set of target grayscale value pair is greater than the preset grayscale value of the corresponding blue sub-pixel, the second target grayscale value is smaller than the preset grayscale value of the corresponding blue sub-pixel, and the grayscale value differences of different sets of target grayscale value pairs are different.

It should be additionally noted that according to the foregoing embodiment, it is only exemplarily set that in the first frame of display cycle F1, the pixel group 10 corresponds to the first target grayscale value pair 80 and 5, and in the second frame of display cycle F2, the pixel group 10 corresponds to the second target grayscale value pair 70 and 10. It may also be set that the pixel groups 10 in two frames of display cycles correspond to another two target grayscale value pairs, which is not limited by the embodiment of this disclosure as long as the target grayscale value pairs corresponding to the pixel groups 10 in the same position on the display panel in the two frames of display cycles are different.

Figure 4:
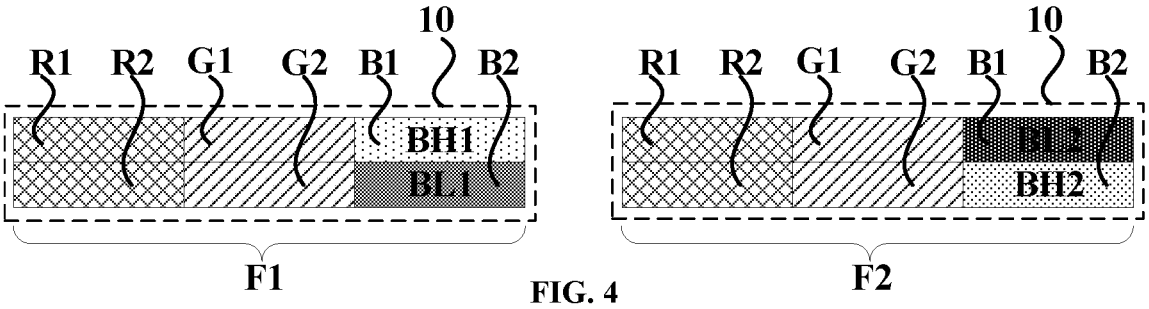
FIG. 4 is another structural schematic diagram of pixel groups in a same position of a display panel in two frames of display cycles according to an embodiment of this disclosure.

Optionally, it may be set that in one of two neighboring frames of display cycles, a grayscale value of a blue sub-pixel on the display panel is greater than a preset grayscale value corresponding to the blue sub-pixel; and in one of the two neighboring frames of display cycles, a grayscale value of a blue sub-pixel in a same position on the display panel is smaller than a preset grayscale value corresponding to the blue sub-pixel. Using a case that m and n are both equal to 2 and the two target grayscale value pairs are the first set of target grayscale value pair BH1 and BL1 and the second set of target grayscale value pair BH2 and BL2 as an example, FIG. 4 is another structural schematic diagram of pixel groups on a display panel in two frames of display cycles according to an embodiment of this disclosure. As shown in FIG. 4, it may be set that in the first frame of display cycle F1, the grayscale value of the blue sub-pixel B1 on the display panel is BH1 that is greater than the preset grayscale value corresponding to the blue sub-pixel B1, and the grayscale value of the blue sub-pixel B2 is BL1 that is smaller than the preset grayscale value corresponding to the blue sub-pixel B1; and then it may be set that in the second frame of display cycle F2, the grayscale value of the blue sub-pixel B1 is BL2 that is smaller than the preset grayscale value corresponding to the blue sub-pixel B1, and the grayscale value of the blue sub-pixel B2 is BH2 that is greater than the preset grayscale value corresponding to the blue sub-pixel B1. That is, it is set that in the first frame of display cycle F1 and the second frame of display cycle F2, the polarity of the difference between the grayscale value BH1 of the blue sub-pixel B1 on the display panel and the preset grayscale value of the corresponding blue sub-pixel B1 is different from the polarity of the difference between the grayscale value BL2 of the blue sub-pixel B1 and the preset grayscale value of the corresponding blue sub-pixel B1, and the polarity of the difference between the grayscale value BL1 of the blue sub-pixel B2 and the preset grayscale value of the corresponding blue sub-pixel B2 is different from the polarity of the difference between the grayscale value BH2 of the blue sub-pixel B2 and the preset grayscale value of the corresponding blue sub-pixel B2. According to the embodiment of this disclosure, in one of two neighboring frames of display cycles, a grayscale value of a blue sub-pixel on the display panel is greater than a preset grayscale value corresponding to the blue sub-pixel; and in one of the two neighboring frames of display cycles, a grayscale value of a blue sub-pixel in a same position on the display panel is smaller than a preset grayscale value corresponding to the blue sub-pixel, thereby preventing the fact that the blue sub-pixels in the same position on the display panel is in the high grayscale state or low grayscale state for a long time, which affects the display effect of the display panel.

Figure 5:
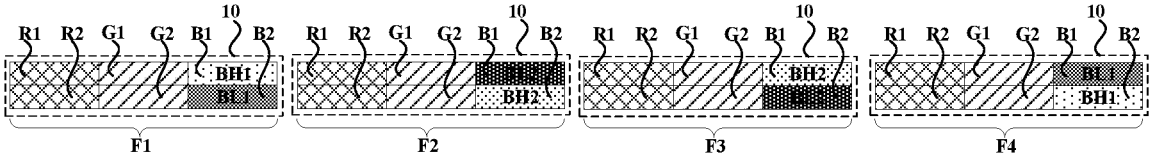
FIG. 5 is a structural schematic diagram of pixel groups in a same position of a display panel in four frames of display cycles according to an embodiment of this disclosure.

Optionally, in the m frames of display cycles, an average of a first target grayscale value and a second target grayscale value of blue sub-pixels in a same position on the display panel may be equal to preset grayscale values corresponding to the blue sub-pixels, where m is an even number greater than 2. Exemplarily, m may be set to 4. FIG. 5 is a structural schematic diagram of pixel groups on a display panel in four frames of display cycles according to an embodiment of this disclosure. As shown in FIG. 5, it may be set that in the first frame of display cycle F1, the grayscale value of the blue sub-pixel B1 is the first target grayscale value BH1 in the first set of target grayscale value pair, and the grayscale value of the blue sub-pixel B2 is the second target grayscale value BL1 in the first set of target grayscale value pair; in the second frame of display cycle F2, the grayscale value of the blue sub-pixel B1 is the second target grayscale value BL2 in the second set of target grayscale value pair, and the grayscale value of the blue sub-pixel B2 is the first target grayscale value BH2 in the second set of target grayscale value pair; in the third frame of display cycle F3, the grayscale value of the blue sub-pixel B1 is the first target grayscale value BH2 in the second set of target grayscale value pair, and the grayscale value of the blue sub-pixel B2 is the second target grayscale value BL2 in the second set of target grayscale value pair; and in the fourth frame of display cycle F4, the grayscale value of the blue sub-pixel B1 is the second target grayscale value BL1 in the first set of target grayscale value pair, and the grayscale value of the blue sub-pixel B2 is the first target grayscale value BH1 in the first set of target grayscale value pair.

In the four frames of display cycles F1-F4, first target grayscale values corresponding to the blue sub-pixel B1 are BH1 and BH2, and second target grayscale values are BL1 and BL2. That is, both BH1 and BL1 appear as grayscale values of the blue sub-pixel B1 in the four frames of display cycles F1-F4, and an average of BH1 and BL1 is equal to the preset grayscale value corresponding to the blue sub-pixel B1; Both BH2 and BL2 appear, and an average of BH2 and BL2 is equal to the preset grayscale value corresponding to the blue sub-pixel B1, and then, in the four frames of display cycles F1-F4, the average of the first target grayscale value and the second target grayscale value of the blue sub-pixel B1 is equal to the preset grayscale value corresponding to the blue sub-pixel B1. Similarly, the average of the first target grayscale value and the second target grayscale value of the blue sub-pixel B2 is also equal to the preset grayscale value corresponding to the blue sub-pixel B2, so that the average of the first target grayscale value and the second target grayscale value corresponding to each blue pixel on the display panel in the m frames of display cycles is equal to the preset grayscale value of the blue sub-pixel, thereby effectively avoiding the problem of flickering of the liquid crystal display panel due to uneven brightness.

Optionally, as shown in FIG. 2, each pixel group 10 may include two neighboring pixels along a column direction of a pixel array, or two pixels along a row direction of the pixel array, and these two pixels may be neighboring or not neighboring, which is not limited by the embodiment of this disclosure. Compared with other setting manners, setting that each pixel group 10 includes two neighboring pixels along the column direction of the pixel array can ensure the resolution of the liquid crystal display panel to the maximum extent.

Figure 6:
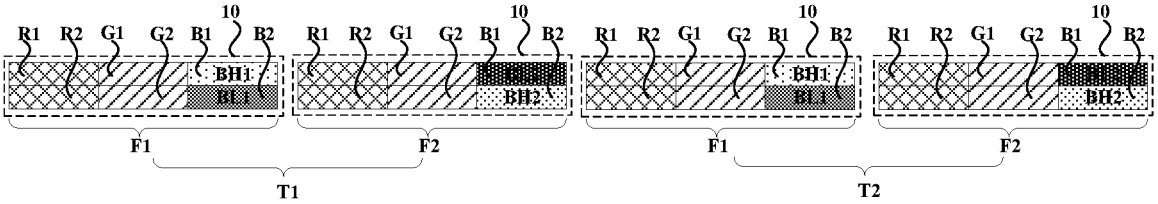
FIG. 6 is a structural schematic diagram of pixel groups in a same position of a display panel in two drive cycles according to an embodiment of this disclosure.

Optionally, the m continuous frames of display cycles may be one drive cycle, and drive sequences of the m frames of display cycles in the two neighboring drive cycles may be the same. Using a case that m is equal to 2 as an example, referring to FIG. 6, drive sequences of two frames of display cycles in the two neighboring drive cycles may be set to be the same, that is, in the first frame of display cycle F1 in the first drive cycle T1, it may be set that the grayscale value of the blue sub-pixel B1 in the pixel group 10 is the first target grayscale value BH1 of the first set of target grayscale value pair and the grayscale value of the blue sub-pixel B2 is the second target grayscale value BL1 of the first set of target grayscale value pair; and in the second frame of display cycle F2 in the first drive cycle T1, it may be set that the grayscale value of the blue sub-pixel B1 of the pixel group 10 is the second target grayscale value BL2 of the second set of target grayscale value pair and the grayscale value of the blue sub-pixel B2 is the first target grayscale value BH2 of the second set of target grayscale value pair. Then in the first frame of display cycle F1 in the second drive cycle T2, it may also be set that the grayscale value of the blue sub-pixel B1 of the pixel group 10 is the first target grayscale value BH1 of the first set of target grayscale value pair and the grayscale value of the blue sub-pixel B2 is the second target grayscale value BL1 of the first set of target grayscale value pair; and in the second frame of display cycle F2 in the second drive cycle T2, it may be set that the grayscale value of the blue sub-pixel B1 of the pixel group 10 is the second target grayscale value BL2 of the second set of target grayscale value pair and the grayscale value of the blue sub-pixel B2 is the first target grayscale value BH2 of the second set of target grayscale value pair.

Figure 7:
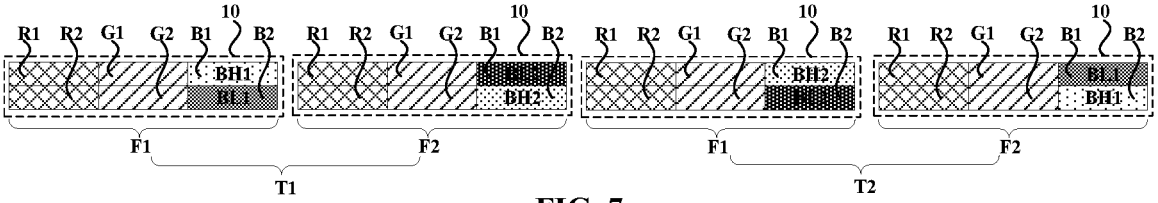
FIG. 7 is another structural schematic diagram of pixel groups in a same position of a display panel in two drive cycles according to an embodiment of this disclosure.

Optionally, the m continuous frames of display cycles may be one drive cycle, and drive sequences of the m frames of display cycles in the two neighboring drive cycles may also be different. Using a case that m is equal to 2 as an example, referring to FIG. 7, the drive sequences of two frames of display cycles in the two neighboring drive cycles may be set to be different, that is, in the first frame of display cycle F1 in the first drive cycle T1, it may be set that the grayscale value of the blue sub-pixel B1 in the pixel group 10 is the first target grayscale value BH1 of the first set of target grayscale value pair and the grayscale value of the blue sub-pixel B2 is the second target grayscale value BL1 of the first set of target grayscale value pair; and in the second frame of display cycle F2 in the first drive cycle T1, it may be set that the grayscale value of the blue sub-pixel B1 of the pixel group 10 is the second target grayscale value BL2 of the second set of target grayscale value pair and the grayscale value of the blue sub-pixel B2 is the first target grayscale value BH2 of the second set of target grayscale value pair. Then in the first frame of display cycle F1 in the second drive cycle T2, it may be set that the grayscale value of the blue sub-pixel B1 of the pixel group 10 is the first target grayscale value BH2 of the second set of target grayscale value pair and the grayscale value of the blue sub-pixel B2 is the second target grayscale value BL2 of the second set of target grayscale value pair; and in the second frame of display cycle F2 in the second drive cycle T2, it may be set that the grayscale value of the blue sub-pixel B1 of the pixel group 10 is the second target grayscale value BL1 of the first set of target grayscale value pair and the grayscale value of the blue sub-pixel B2 is the first target grayscale value BH1 of the first set of target grayscale value pair.

Figure 8:
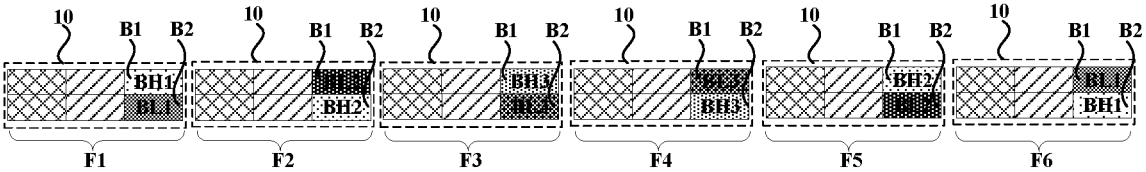
FIG. 8 is a structural schematic diagram of pixel groups in a same position of a display panel in six frames of display cycles according to an embodiment of this disclosure.

Exemplarily, it may be set that m is equal to 6 and n is equal to 3. That is, a pixel group structure in a same position of the display panel in six frames of display cycles shown in FIG. 8 may further be used to obtain three target grayscale value pairs by lookup of Table 1 according to the average of the preset grayscale values of the blue sub-pixels B1 and B2. Exemplarily, as shown in FIG. 8, it may be set that in the first frame of display cycle F1, the grayscale value of the blue sub-pixel B1 is the first target grayscale value BH1 in the first set of target grayscale value pair, and the grayscale value of the blue sub-pixel B2 is the second target grayscale value BL1 in the first set of target grayscale value pair; in the second frame of display cycle F2, the grayscale value of the blue sub-pixel B1 is the second target grayscale value BL2 in the second set of target grayscale value pair, and the grayscale value of the blue sub-pixel B2 is the first target grayscale value BH2 in the second set of target grayscale value pair; in the third frame of display cycle F3, the grayscale value of the blue sub-pixel B1 is the first target grayscale value BH3 in the third set of target grayscale value pair, and the grayscale value of the blue sub-pixel B2 is the second target grayscale value BL3 in the third set of target grayscale value pair; in the fourth frame of display cycle F4, the grayscale value of the blue sub-pixel B1 is the second target grayscale value BL3 in the third set of target grayscale value pair, and the grayscale value of the blue sub-pixel B2 is the first target grayscale value BH3 in the third set of target grayscale value pair; in the fifth frame of display cycle F5, the grayscale value of the blue sub-pixel B1 is the first target grayscale value BH2 in the second set of target grayscale value pair, and the grayscale value of the blue sub-pixel B2 is the second target grayscale value BL2 in the second set of target grayscale value pair; and in the sixth frame of display cycle F6, the grayscale value of the blue sub-pixel B1 is the second target grayscale value BL1 in the first set of target grayscale value pair, and the grayscale value of the blue sub-pixel B2 is the first target grayscale value BH1 in the first set of target grayscale value pair.

It should be noted that, in the embodiment of this disclosure, a value of a preset grayscale voltage corresponding to a blue sub-pixel in the display panel is not limited, and the preset grayscale voltage corresponding to the blue sub-pixel may be set according to the actual design demand of the product.

Figure 9:
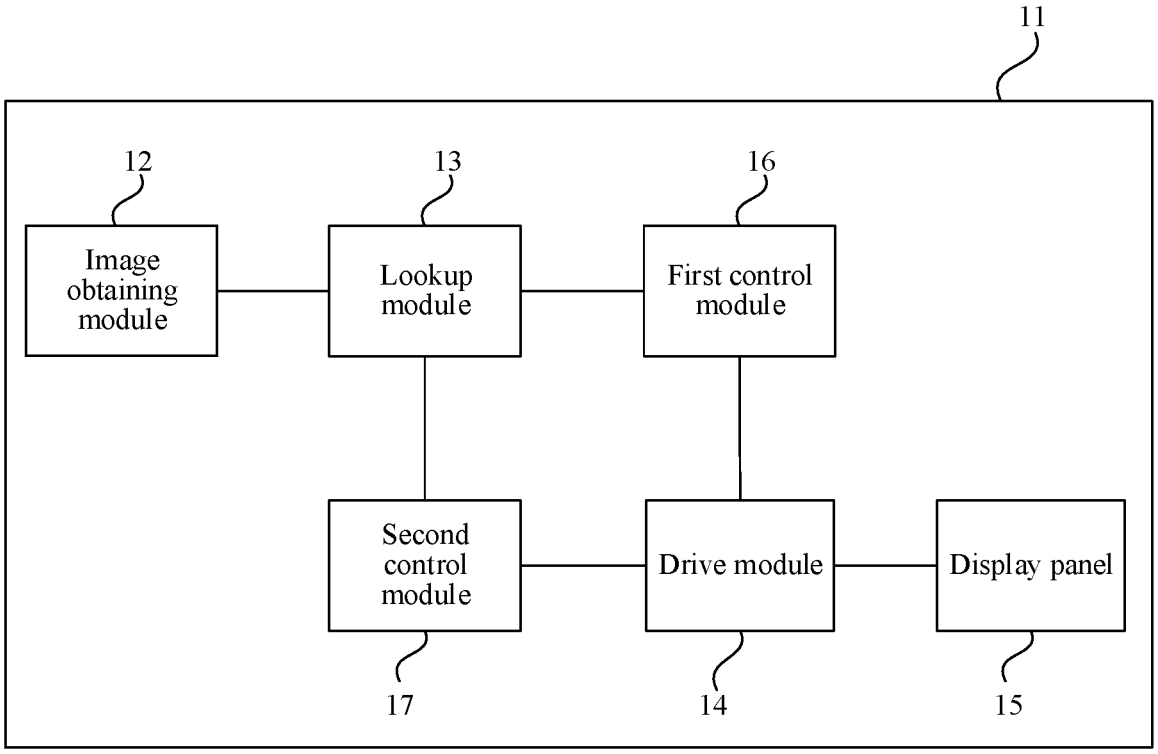
FIG. 9 is a structural schematic diagram of a display device according to an embodiment of this disclosure.

FIG. 9 is a structural schematic diagram of a display device according to an embodiment of this disclosure. As shown in FIG. 9, the display device 11 includes an image obtaining module 12, a lookup module 13, a first control module 16, a drive module 14, a second control module 17 and a display panel 15. The lookup module 13 is electrically connected to the image obtaining module 12, the first control module 16 is electrically connected to the lookup module 13, the drive module 14 is electrically connected to the first control module 16 and the display panel 15, and the second control module 17 is electrically connected to the lookup module 13 and the drive module 14. The image obtaining module 12 is configured to obtain a pre-display image, where each sub-pixel in the pre-display image corresponds to a preset grayscale value. The lookup module 13 is configured to obtain, according to an average of preset grayscale values corresponding to two blue sub-pixels in a pixel group, n sets of target grayscale value pairs corresponding to the pixel group by table lookup; and each set of the target grayscale value pairs includes a first target grayscale value and a second target grayscale value, the first control module 16 is configured to control grayscale value differences of the n sets of target grayscale value pairs to be different, and the grayscale value difference is equal to the first target grayscale value minus the second target grayscale value of a same set of target grayscale value pair. The drive module 14 is configured to drive the display panel to display a same pre-display image in m continuous frames of display cycles; and in a same frame of display cycle, grayscale values of the two blue sub-pixels in the pixel group are the first target grayscale value and the second target grayscale value in a set of target grayscale value pair. The second control module 17 is configured to control the first target grayscale value of each set of target grayscale value pair to be greater than a preset grayscale value of a corresponding blue sub-pixel and the second target grayscale value to be smaller than a preset grayscale value of a corresponding blue sub-pixel, and in at least two frames of display cycles, and target grayscale value pairs corresponding to pixel groups in a same position on the display panel are different, where m is an integer greater than 1, and n is an integer greater than 1 and less than or equal to m; and the display panel 15 includes a plurality of pixel groups, and each pixel group includes two blue sub-pixels.

Optionally, the second control module 17 is also configured to control a grayscale value of a blue sub-pixel on the display panel to be greater than a preset grayscale value corresponding to the blue sub-pixel in one of two neighboring frames of display cycles, and control a grayscale value of a blue sub-pixel in a same position on the display panel to be smaller than a preset grayscale value corresponding to the blue sub-pixel in one of the two neighboring frames of display cycles.

Optionally, the second control module is also configured to control an average of a first target grayscale value and a second target grayscale value of blue sub-pixels in a same position on the display panel to be equal to preset grayscale values corresponding to the blue sub-pixels in the m frames of display cycles, where m is an even number greater than 2.

Optionally, the m continuous frames of display cycles are one drive cycle, and drive sequences of the m frames of display cycles in two neighboring drive cycles may be the same or different.

Figure 10:
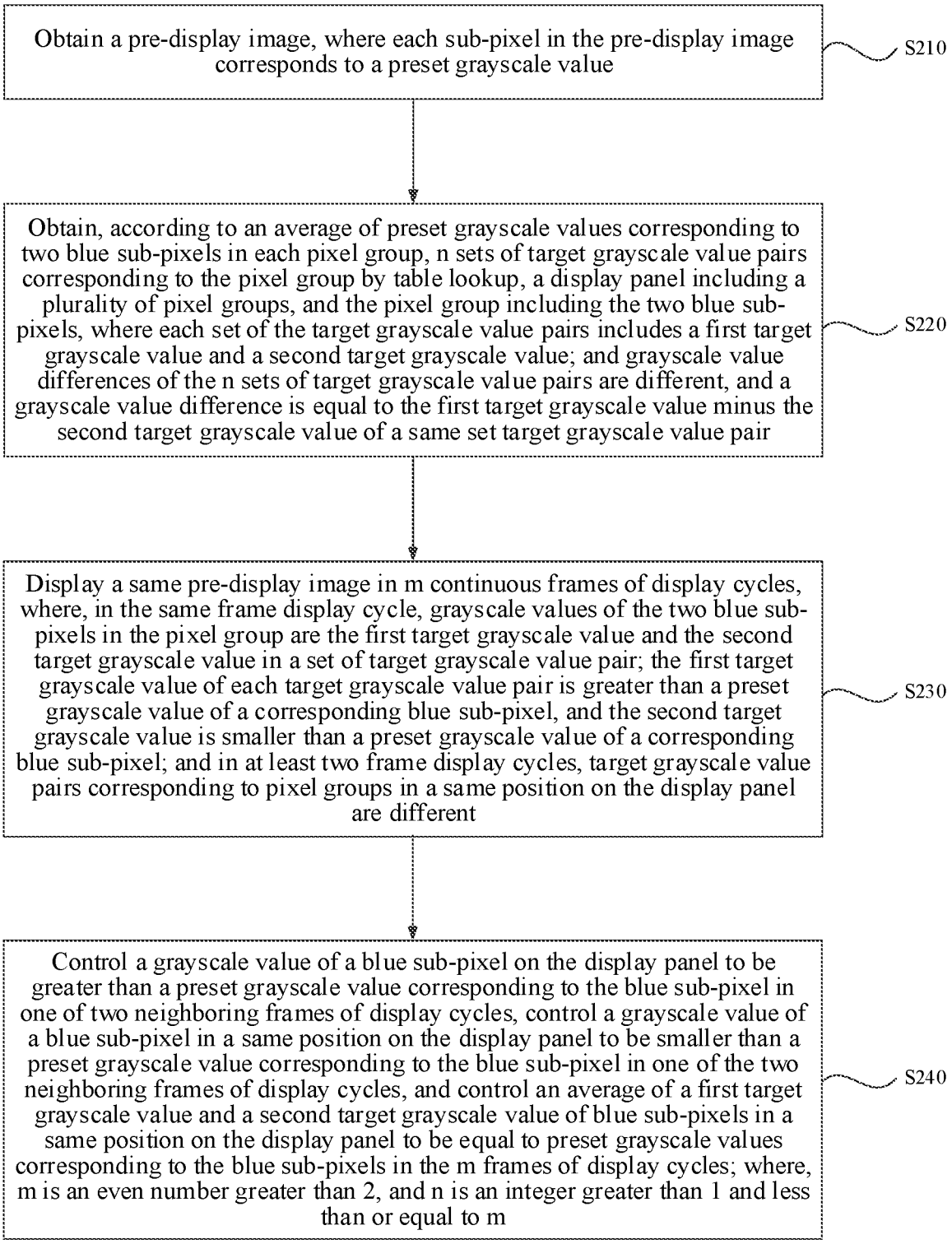
FIG. 10 is a flowchart of another driving method for a display device according to an embodiment of this disclosure.

FIG. 10 is a flowchart of another driving method for a display device according to an embodiment of this disclosure. The driving method can be applied to a scene that needs to drive the display device for display, and can be executed by the display device provided by the embodiment of this disclosure. The method includes steps S210 to S240.

Step S210: Obtain a pre-display image, where each sub-pixel in the pre-display image corresponds to a preset grayscale value.

Step S220: Obtain, according to an average of preset grayscale values corresponding to two blue sub-pixels in each pixel group, n sets of target grayscale value pairs corresponding to the pixel group by table lookup, a display panel including a plurality of pixel groups, and the pixel group including the two blue sub-pixels, where each of the target grayscale value pairs includes a first target grayscale value and a second target grayscale value; and grayscale value differences of the n sets of target grayscale value pairs are different, and the grayscale value difference is equal to the first target grayscale value minus the second target grayscale value of a same set of target grayscale value pair.

Step S230: Display a same pre-display image in m continuous frames of display cycles, where in a same frame of display cycle, grayscale values of the two blue sub-pixels in the pixel group are the first target grayscale value and the second target grayscale value in a set of target grayscale value pair; the first target grayscale value of each target grayscale value pair is greater than a preset grayscale value of a corresponding blue sub-pixel, and the second target grayscale value is smaller than a preset grayscale value of a corresponding blue sub-pixel; and in at least two frames of display cycles, target grayscale value pairs corresponding to pixel groups in a same position on the display panel are different.

Step S240: Control a grayscale value of a blue sub-pixel on the display panel to be greater than a preset grayscale value corresponding to the blue sub-pixel in one of two neighboring frames of display cycles, control a grayscale value of a blue sub-pixel in a same position on the display panel to be smaller than a preset grayscale value corresponding to the blue sub-pixel in one of the two neighboring frames of display cycles, and control an average of a first target grayscale value and a second target grayscale value of blue sub-pixels in a same position on the display panel to be equal to preset grayscale values corresponding to the blue sub-pixels in the m frames of display cycles, where m is an even number greater than 2, and n is an integer greater than 1 and less than or equal to m.

By displaying a same pre-display image in m continuous frames of display cycles, and setting that in a same frame of display cycle, the grayscale values of two blue sub-pixels in a pixel group are respectively a first target grayscale value and a second target grayscale value in a set of target grayscale value pair, the first target grayscale value of each set of target grayscale value pair is greater than a preset grayscale value of a corresponding blue sub-pixel, and the second target grayscale value is smaller than a preset grayscale value of a corresponding blue sub-pixel, the problem of color shift of the liquid crystal display panel under a large viewing angle is alleviated, and the problem that the metal wires and thin film transistor elements affect the transmittance of the display panel in the prior art is resolved. It also set that in at least two frames of display cycles, target grayscale value pairs corresponding to pixel groups in a same position on the display panel are different, while the target grayscale values corresponding to the pixel groups in the same position on the display panel in each frame of display cycle are the same, so that the gamma curve corresponding to the blue sub-pixel can approximate to the front-viewing-angle gamma curve to the greatest extent whether it corresponds to a high grayscale region or a low grayscale region, thereby further alleviating the problem of color shift of the liquid crystal display panel under the large viewing angle.

It should be noted that the foregoing descriptions are merely embodiments of this disclosure and used technical principles. A person skilled in the art may understand that this disclosure is not limited to particular embodiments herein. A person skilled in the art makes various obvious changes, adjustments and replacements without departing from the protection scope of this disclosure. Therefore, although this disclosure is described in detail by using the foregoing embodiments, this disclosure is not limited to only the foregoing embodiments. More other equivalent embodiments may further be included without departing from the concept of this disclosure. The scope of this disclosure is defined by the scope of appended claims.

The invention claimed is:

1. A driving method for a display device, comprising:

obtaining a pre-display image, wherein each sub-pixel in the pre-display image corresponds to a preset grayscale value;

obtaining, according to an average of preset grayscale values corresponding to two blue sub-pixels in a pixel group, n sets of target grayscale value pairs corresponding to the pixel group by table lookup, a display panel of the display device comprising a plurality of pixel groups, and the pixel groups comprising the two blue sub-pixels, wherein each set of the target grayscale value pairs comprises a first target grayscale value and a second target grayscale value; grayscale value differences of the n sets of target grayscale value pairs are different, and the grayscale value differences is equal to the first target grayscale value minus the second target grayscale value of a same set of target grayscale value pairs; and displaying a same pre-display image in m continuous frames of a display cycle, wherein in a same frame of the display cycle, grayscale values of the two blue sub-pixels in the pixel group are the first target grayscale value and the second target grayscale value in a set of target grayscale value pairs; the first target grayscale value of each set of target grayscale value pairs is greater than a preset grayscale value of a corresponding blue sub-pixel, and the second target grayscale value is smaller than a preset grayscale value of a corresponding blue sub-pixel; and in at least two frames of the display cycle, target grayscale value pairs corresponding to pixel groups in a same position on the display panel are different; and m is an integer greater than 1, and n is an integer greater than 1 and less than or equal to m.

2. The driving method according to claim 1, wherein in one of two neighboring frames of the display cycle, a grayscale value of a blue sub-pixel on the display panel is greater than a preset grayscale value corresponding to the blue sub-pixel; and in one of the two neighboring frames of the display cycle, a grayscale value of a blue sub-pixel in a same position on the display panel is smaller than a preset grayscale value corresponding to the blue sub-pixel.

3. The driving method according to claim 1, wherein in the m frames of the display cycle, an average of a first target grayscale value and a second target grayscale value of blue sub-pixels in a same position on the display panel is equal to preset grayscale values corresponding to the blue sub-pixels, wherein m is an even number greater than 2.

4. The driving method according to claim 1, wherein each of the pixel groups comprises two neighboring pixels along a column direction of a pixel array.

5. The driving method according to claim 1, wherein the m continuous frames of the display cycle are one drive cycle, and drive sequences of the m frames of the display cycles in two neighboring drive cycles are identical or different.

6. The driving method according to claim 1, wherein a wavelength of light emitted by a blue sub-pixel is greater than or equal to 400 nm and less than or equal to 480 nm.

7. The driving method according to claim 1, wherein each of the pixel groups further comprises a red sub-pixel R and a blue sub-pixel B.

8. A display device, comprising:

a display panel, comprising a plurality of pixel groups, each of the pixel groups comprising two blue sub-pixels;

the display device further comprises a processor and a memory storing computer readable instructions thereon, which, when executed by the processor, cause the processor to:

obtain a pre-display image, wherein each sub-pixel in the pre-display image corresponds to a preset grayscale value;

obtain, according to an average of preset grayscale values corresponding to the two blue sub-pixels in the pixel groups, n sets of target grayscale value pairs corresponding to the pixel groups by table lookup;

wherein each set of the target grayscale value pairs comprises a first target grayscale value and a second target grayscale value, the first control module is configured to control the grayscale value differences of the n sets of target grayscale value pairs to be different, and the grayscale value difference is equal to the first target grayscale value minus the second target grayscale value of a same set of target grayscale value pairs;

drive the display panel to display a same pre-display image in m continuous frames of a display cycle; and wherein in a same frame of the display cycle, grayscale values of two blue sub-pixels in the pixel group are the first target grayscale value and the second target grayscale value in a set of target grayscale value pairs; the second control module is configured to control the first target grayscale value of each set of target grayscale value pairs to be greater than a preset grayscale value of a corresponding blue sub-pixel and the second target grayscale value to be smaller than a preset grayscale value of a corresponding blue sub-pixel, and in at least two frames of the display cycle, and target grayscale value pairs corresponding to pixel groups in a same position on the display panel are different, wherein m is an integer greater than 1, and n is an integer greater than 1 and less than or equal to m.

9. The display device according to claim 8, wherein when the computer readable instructions are executed by the processor, the processor is further caused to:

control a grayscale value of a blue sub-pixel on the display panel to be greater than a preset grayscale value corresponding to the blue sub-pixel in one of two neighboring frames of the display cycle; and a grayscale value of a blue sub-pixel in a same position on the display panel to be smaller than a preset grayscale value corresponding to the blue sub-pixel in one of the two neighboring frames of the display cycle.

10. The display device according to claim 8, wherein when the computer readable instructions are executed by the processor, the processor is further caused to:

control an average of a first target grayscale value and a second target grayscale value of blue sub-pixels in a same position on the display panel to be equal to preset grayscale values corresponding to the blue sub-pixels in the m frames of the display cycle, wherein m is an even number greater than 2.

11. The display device according to claim 8, wherein the m continuous frames of the display cycle are one drive cycle, and when the computer readable instructions are executed by the processor, the processor is further caused to control drive sequences of the m frames of the display cycle in two neighboring drive cycles to be identical or different.

12. The display device according to claim 8, wherein a wavelength of light emitted by a blue sub-pixel is greater than or equal to 400 nm and less than or equal to 480 nm.

13. The display device according to claim 8, wherein each of the pixel groups further comprises a red sub-pixel R and a blue sub-pixel B.

14. A driving method for a display device, comprising:

obtaining a pre-display image, wherein each sub-pixel in the pre-display image corresponds to a preset grayscale value;

obtaining, according to an average of preset grayscale values corresponding to two blue sub-pixels, n sets of target grayscale value pairs corresponding to a pixel group by table lookup, a display panel of the display device comprising a plurality of pixel groups, and each of the pixel groups comprising the two blue sub-pixels, wherein each set of the target grayscale value pairs comprises a first target grayscale value and a second target grayscale value; grayscale value differences of the n sets of target grayscale value pairs are different, and the grayscale value difference is equal to the first target grayscale value minus the second target grayscale value of a same set of target grayscale value pairs; and displaying a same pre-display image in m continuous frames of display cycles, wherein in a same frame of the display cycle, grayscale values of the two blue sub-pixels in the pixel groups are the first target grayscale value and the second target grayscale value in a set of target grayscale value pairs; the first target grayscale value of each target grayscale value pairs is greater than a preset grayscale value of a corresponding blue sub-pixel, the second target grayscale value is smaller than a preset grayscale value of a corresponding blue sub-pixel, and in at least two frames of the display cycle, target grayscale value pairs corresponding to the pixel groups in a same position on the display panel are different; and in one of two neighboring frames of the display cycle, a grayscale value of a blue sub-pixel on the display panel is greater a preset grayscale value corresponding to the blue sub-pixel, in one of the two neighboring frames of the display cycle, a grayscale value of a blue sub-pixel in a same position on the display panel is smaller than a preset grayscale value corresponding to the blue sub-pixel, and in the m frames of the display cycle, an average of a first target grayscale value and a second target grayscale value of blue sub-pixels in a same position on the display panel is equal to preset grayscale values corresponding to the blue sub-pixels, wherein m is an even number greater than 2, and n is an integer greater than 1 and less than or equal to m.

15. The driving method for the display device according to claim 14, wherein each of the pixel groups comprises two neighboring pixels along a column direction of a pixel array.

16. The driving method for the display device according to claim 14, wherein the m continuous frames of the display cycle are one drive cycle, and drive sequences of the m frames of the display cycles in two neighboring drive cycles are identical or different.

17. The driving method for the display device according to claim 14, wherein a wavelength of light emitted by a blue sub-pixel is greater than or equal to 400 nm and less than or equal to 480 nm.

18. The driving method for the display device according to claim 14, wherein each of the pixel groups further comprises a red sub-pixel R and a blue sub-pixel B.

19. The driving method for the display device according to claim 14, wherein a preset grayscale value of one blue sub-pixel in one of a plurality of pixel groups is 1.5, and a preset grayscale value of another one blue sub-pixel is 2.5.

20. The driving method for the display device according to claim 14, wherein m is equal to 2.

* * * * *